US009976364B2

(12) United States Patent
Shilling, III et al.

(10) Patent No.: US 9,976,364 B2
(45) Date of Patent: May 22, 2018

(54) FLOATING OIL AND GAS FACILITY WITH A MOVABLE WELLBAY ASSEMBLY

(71) Applicant: Frontier Deepwater Appraisal Solutions LLC, Houston, TX (US)

(72) Inventors: Roy B. Shilling, III, Houston, TX (US); Charles N. White, Spicewood, TX (US); Howard W.F. Day, Houston, TX (US)

(73) Assignee: FRONTIER DEEPWATER APPRAISAL SOLUTIONS LLC, Houston, TX (US)

( * ) Notice: Subject to any disclaimer, the term of this patent is extended or adjusted under 35 U.S.C. 154(b) by 0 days. days.

(21) Appl. No.: 15/482,064

(22) Filed: Apr. 7, 2017

(65) Prior Publication Data

US 2018/0066481 A1 Mar. 8, 2018

Related U.S. Application Data

(60) Provisional application No. 62/384,626, filed on Sep. 7, 2016.

(51) Int. Cl.

| | |
|---|---|
| ***E21B 19/00*** | (2006.01) |
| ***E21B 15/02*** | (2006.01) |
| ***B63B 35/44*** | (2006.01) |
| ***B63B 21/20*** | (2006.01) |

(52) U.S. Cl.

CPC ..... *E21B 19/006* (2013.01); *B63B 21/20* (2013.01); *B63B 35/4413* (2013.01); *E21B 15/02* (2013.01); *B63B 2021/203* (2013.01)

(58) Field of Classification Search

CPC ..... E21B 19/006; E21B 15/02; E21B 15/003; E21B 19/004; B63B 21/20; B63B 35/4413; B63B 2021/203

See application file for complete search history.

(56) References Cited

U.S. PATENT DOCUMENTS

| | | | | |
|---|---|---|---|---|
| 4,367,796 A | | 1/1983 | Bolding | |
| 4,657,439 A | * | 4/1987 | Petersen | E21B 19/006 166/341 |
| 5,147,148 A | | 9/1992 | White et al. | |

(Continued)

FOREIGN PATENT DOCUMENTS

| | | | | |
|---|---|---|---|---|
| CA | 2383418 A1 | * | 3/2001 | E21B 19/002 |
| WO | WO-2012104309 A2 | * | 8/2012 | B63B 35/4406 |
| WO | WO-2016054610 A1 | * | 4/2016 | E21B 15/02 |

*Primary Examiner* — James G Sayre

(74) *Attorney, Agent, or Firm* — Jeffrey L. Wendt; The Wendt Firm, P.C.

(57) ABSTRACT

A mobile offshore drilling unit is converted to provide drilling, completion and workover access to multiple dry tree wells from a drilling derrick to allow production and export of oil and gas from high pressure, high temperature reservoirs in deep offshore waters. Existing practice has been for the drilling derrick on a production platform supporting dry tree wells to be moved over a fixed well slot. The present invention provides a movable wellbay that supports multiple top-tensioned subsea well tieback risers, which may be positioned directly below the derrick's rotary table and/or beneath another operating device. The use of top-tensioned subsea well tieback risers supported by the movable wellbay allows the converted facility to drill, complete, maintain, improve and produce from subsea wells through dry trees.

19 Claims, 5 Drawing Sheets

(56) References Cited

U.S. PATENT DOCUMENTS

| | | | | |
|---|---|---|---|---|
| 5,150,987 | A | 9/1992 | White et al. | |
| 5,492,436 | A | 2/1996 | Suksumake | |
| 6,041,865 | A | 3/2000 | Knapp | |
| 6,321,675 | B1 * | 11/2001 | Dybdahl | B63B 35/4413 114/264 |
| 6,431,284 | B1 | 8/2002 | Finn et al. | |
| 6,648,074 | B2 | 11/2003 | Finn et al. | |
| 6,691,784 | B1 | 2/2004 | Wanvick et al. | |
| 6,692,193 | B2 | 2/2004 | Beynet et al. | |
| 6,766,860 | B2 | 7/2004 | Archibald et al. | |
| 7,451,821 | B2 | 11/2008 | Rashid et al. | |
| 7,628,225 | B2 | 12/2009 | Petersson et al. | |
| 8,083,440 | B2 | 12/2011 | Curtiss, III | |
| 8,251,003 | B2 | 8/2012 | Vandenworm | |
| 8,522,880 | B2 | 9/2013 | Roodenburg et al. | |
| 9,238,943 | B2 | 1/2016 | Jordan | |
| 9,341,024 | B2 | 5/2016 | Labrugere | |
| 2002/0074125 | A1 * | 6/2002 | Fikes | E21B 15/003 166/352 |
| 2003/0063953 | A1 * | 4/2003 | Beynet | E21B 19/006 405/224.4 |
| 2003/0159853 | A1 * | 8/2003 | Archibald | E21B 19/004 175/8 |
| 2004/0134661 | A1 * | 7/2004 | von der Ohe | E21B 19/004 166/367 |
| 2010/0147528 | A1 | 6/2010 | Baugh | |
| 2012/0018166 | A1 | 1/2012 | Croatto | |
| 2012/0201611 | A1 * | 8/2012 | Flores, Sr. | E21B 19/006 405/224.4 |
| 2013/0098627 | A1 * | 4/2013 | Jordan | E21B 7/12 166/355 |
| 2013/0189039 | A1 | 7/2013 | Wanvik et al. | |
| 2013/0195559 | A1 | 8/2013 | Andresen et al. | |
| 2015/0068726 | A1 | 3/2015 | Vogt et al. | |
| 2017/0298694 | A1 * | 10/2017 | Jordan | E21B 7/12 |
| 2017/0321498 | A1 * | 11/2017 | Mabile | E21B 19/006 |

* cited by examiner

FLOATING OIL AND GAS FACILITY WITH A MOVABLE WELLBAY ASSEMBLY

CROSS REFERENCE TO RELATED APPLICATIONS

This application claims priority to and the benefit of U.S. Provisional Patent Application Ser. No. 62/384,626 filed on Sep. 7, 2016, which is incorporated by reference.

BACKGROUND OF THE INVENTION

1. Field of the Invention

This application relates generally to offshore oil and gas wells and other subterranean exploration and production activities and more specifically to floating production systems built or made by converting mobile offshore drilling units (MODUs) to include a movable wellbay structure and a multi-well dry-tree production system that enables drilling, evaluation, completion, and maintenance of offshore wells.

2. Description of the Related Art

U.S. Pat. No. 5,150,987, issued to White et al., describes a heave-restrained platform and drilling system (HRP/DS) for drilling and producing through oil wells in deep water that included a floating structure having a central buoyancy means, at least three out-rigger columns, and a hybrid mooring system in which a spread (lateral) mooring system functions with an array of tensioned production risers (serving as a vertical tension leg) to keep the structure generally over a specified seabed location. Risers are connected to hydrocarbon wells on the floor of a body of water upon which the floating structure floats within a horizontal locus generally beneath the floating structure and being connected to the floating structure under sufficient tension such as to also function as tendons to restrain heave of the floating structure in addition to functioning as conduits for hydrocarbon production. At least three lateral anchor lines were attached to the floating structure and to the floor of the body of water at loci lateral of the locus of attachment of the risers and under sufficient tension and in an array such as to maintain the floating structure substantially on horizontal location.

INTRODUCTION TO THE INVENTION

Many of the new discoveries in the Gulf of Mexico (GoM) combine extreme water depths with high pressure, high temperature (HPHT) reservoir conditions where mudline shut in pressures can approach or even exceed 15 ksi. These wells are much deeper than what has been typical of past developments. Instead of 20,000 foot total measured depths (TMD), HPHT wells tend to be greater than 30,000 feet TMD. Drilling and completion costs become a more dominant factor in the selection of the development concept, where savings between a dry tree well versus a wet tree subsea completed well can be over $150,000,000 per well. For a 5-10 well development of such challenging reservoirs, it is likely to require 5-8 years just to drill and complete the initial production wellbores. Another key advantage of dry trees is the significantly increased capability for well surveillance, wire line logging, interventions etc. as enhanced by simpler completion technology. Also, the ability to run and more easily service downhole electric pumps, can significantly increase well rate and reserve recovery when compared to subsea wells which have their well tieback and control trees sitting at the seafloor. The combination of all these factors puts greater emphasis on dry tree technology as an enabler for economic development of HPHT reservoirs in deep waters.

The current GoM deep water commercial environment has much greater reservoir uncertainty compared to the first wave of deep water developments by industry. Many reservoirs (for example, those in the Lower Tertiary Paleogene Wilcox play) lie beneath a layer of subterranean salt (labelled as "subsalt") with poor seismic resolution and the inability to clearly define reservoir extent, fault blocks, and continuity. Exploration wells on these prospects have cost over 500 million dollars and have taken over 1 year to fully drill and evaluate. The extreme costs and timelines associated with drilling and evaluation reduces the number of appraisal wells that are feasible, resulting in unusually long appraisal timelines to gather information intended to support complex decisions regarding costly field development schemes. The end result is that Operators are being forced to make much bigger and riskier financial bets on these developments without critical information to resolve a number of key reservoir performance and reserve recovery factors.

Drilling and completion costs on wells into the Paleogene are likely to ultimately be 60% to 75% of the total project cost. This unusual cost structure imbalance is very different from the cost allocations for historic deep water development in the GoM, in which facility costs dominated field development concept selection. Paleogene development concepts are optimized by focusing on reducing drilling and completion costs, increasing reservoir surveillance, improving workover, and recompletion, intervention and maintenance capability all leading to increased reserve recovery. This is a paradigm shift for project teams that are dominated by facility expertise and tend to remain focused on the type of floater to select with lesser regard for how this might impact drilling and completion costs. Facility costs are expected to be less than 40% of the overall Paleogene project cost, and the disproportionate effort to reduce facility and topside costs rather than drilling and completion costs cannot significantly improve project economics. The key, then, is to focus on adaptive development strategies that significantly reduce drilling costs and provide production and reservoir dynamic data that changes the game from having to guess right to a strategy that provides the operator with truly robust capability to appraise the reservoir, while retaining the flexibility for future redeployment and reuse, if required.

The application of dry tree development to GoM Paleogene reserves is strongly aligned with fundamentals of reducing complexity and risk. Dual barrier fully pressure rated top tension risers provide direct access to the reservoir with simpler and more reliable surface trees and BOP's that can be easily monitored and maintained in a high state of reliability. Typically, dry tree drilling and completion equipment is an order of magnitude simpler with fewer moving parts compared to equivalent wet tree technology. In ultra-deep waters, the adoption of a dry tree tieback solution can eliminate the use of highly expensive and relatively unproven 20 ksi subsea trees and high integrity pipeline protection systems (HIPPS).

The use of a permanent taut-leg spread mooring system instead of a dynamic positioning (DP) system to hold a vessel on site eliminates the need for emergency disconnection of the drilling riser, and the risers do not have to be retrieved for hurricane abandonment. A study conducted as part of the Norwegian Deepwater Research Program (Reliability Study, Phase 2 Report No: A3314/C/NDE/RBB, February 1999) indicated that position excursions which are likely to lead to physical damage are approximately two orders of magnitude less likely for a moored floater versus one depending on DP.

Well surveillance (also called "monitoring") and interventions are extremely important in evaluating well performance and maximizing recovery from new geologic horizons like the Paleogene. According to Norwegian Petroleum Directorate's Director General, Gunnar Berge, at the Subsea Conference in Bergen, Mar. 17, 2004, a study performed by Statoil and the Norwegian Petroleum Directorate showed that the recovery factor from subsea wells is 15-20 percent lower than from wells with direct vertical access. The accessibility to subsea completed wells is more difficult and represents larger costs than wells drilled from a dry tree installation. Even for minor jobs a mobile rig is often required. The study went on to conclude that performance from dry tree wells is 25% better than subsea wells drilled in the same geologic environment (Well Intervention, Offshore Magazine Jun. 1, 2001). The main difference being that ready access for light intervention and wireline work on dry tree wells compared to the much more expensive and fewer options on the subsea analog. Surveillance in the form of compaction logging, production inflow and multi-rate production logging of individual reservoir layers has significantly contributed to better production performance of dry tree wells (SPE Paper 115365).

Another key factor particularly for GoM economics is the differential drilling and completion times as the result of the impact of hurricanes and loop currents. Drilling riser deployment and retrieval times can have a significant impact on subsea well costs. Dynamically. Positioned mobile offshore drilling units (DP MODUs) capable of drilling and completing high pressure/high temperature (HPHT) Paleogene wells can be expected to carry fully burdened or "loaded" dayrates greater than $1 million/day. In 5,000 ft of water, deploying a subsea BOP and drilling riser can take 2-3 days, with even more time required to retrieve the riser in the event of well abandonment for hurricanes. The total time required to prepare for abandonment, abandon the site, return and restart well operations in ultra-deep water Gulf of Mexico can mean 2 to 3 weeks of lost work whenever a hurricane threatens. Further, each floating drilling rig experiences on average 2 to 3 temporary abandonments caused by hurricanes in the Gulf every year, forcing operators to plan on about 6 weeks of expensive hurricane-induced downtime.

With dry trees, the drilling and production risers and facility are designed to remain connected throughout any hurricane—no riser retrieval is required. Lost time is greatly reduced, and in some cases can be eliminated, due to the ability to wait longer and monitor the path of the hurricane and determine that the path will remain well away from the facility.

There can also be knock-on downtime associated with the effects of loop currents in suspending DP operations sooner or delaying riser connection post abandonment. MODU drilling risers cannot be run and retrieved in currents exceeding 1.5-2.0 knots. Retrieval and running operations during hurricane season must be carefully managed to ensure that successful hurricane abandonment can be accomplished in front of an approaching storm. Loop current events can last for weeks and can be a significant issue especially as operations move further out past 5,000 foot water depth contours. Rigs may have to wait additional time to allow loop currents to move away from the well location in order to re-run and re-connect the drilling riser.

Yet another significant issue is tripping a subsea BOP for repair versus a surface BOP. The additional time to abandon the well and retrieve the riser and BOP can result in a significant cost impact in terms of several weeks of downtime for each repair. A surface BOP in many cases can be repaired "hands-on" without well abandonment and without removing the BOP. A surface BOP with direct hydraulic controls is much more reliable than a complicated subsea BOP with electro-hydraulic multi-plex controls. Recent regulatory changes by the United States have introduced even more strict repair and maintenance requirements which force Operators to retrieve the BOP to surface for repair of any problem that cannot be repaired subsea. Surface BOP direct hydraulic control systems have been shown to be an order of magnitude more reliable than subsea multi-plex controls.

In recent years, there has been a substantial number of discoveries of HPHT oil-bearing formations in ultra-deep waters in the US Gulf of Mexico. The US government requires that these discoveries be developed and produced in a timely fashion or the offshore leases encompassing these potentially world-class assets must be relinquished. Today's predictions that relatively low oil prices will be sustained for many years make it imprudent for the lease holders to sanction extremely costly developments for these discoveries without having adequate understanding of the reservoirs productive capacities and requirements. As a result, even though the discoveries appear to be massive, their complexity and the high cost of complying with the requirements for holding onto the leases are creating financial pressures that can force the leaseholders to allow their leases and all the information and drilling results their efforts to date have generated to be relinquished back to the US people. In such cases, the relevant offshore blocks can be put up for auction again at a future date.

Those leaseholders are pushed to this decision when their fully risked economic analyses indicate that the uncertainties regarding the productivity of the reservoir, the cost of development and operation, and the value of the produced fluids cannot be expected to be economically resolved with existing technologies.

Introducing a system that allows the use of dry tree wells will avoid the financial penalties that HPHT subsea drilling operations and subsea tree well tieback systems impose on the economics of the recently discovered Lower Tertiary resource in the ultra-deep waters of the Gulf of Mexico.

SUMMARY OF THE INVENTION

An offshore floating facility for oil and gas' well drilling, evaluation, completion, improvement, maintenance and/or production includes: a semisubmersible vessel or a monohull vessel having a vertical opening referred to as a moonpool, where the vessel has bulkhead and deck structures, and where the vessel has an upper drilling deck that surrounds the moonpool; a drilling derrick with a primary operating device that may be positioned and/or secured to the drilling deck over the moonpool; mooring lines attached to the vessel for anchoring the vessel; a wellbay assembly located at least partially in the moonpool, wherein the wellbay assembly is movable, where the wellbay assembly has at least two sets of riser tensioners in an array of structurally distinct slots, and where each riser tensioner set is designed and built to hold a riser in tension; and means for moving the wellbay assembly for aligning an upper end of first one riser and then a different riser below the drilling derrick. The floating platform preferably further includes structure and equipment for enabling operations on and production from and vertical access to subsea completed wells with wet trees or surface completed wells with dry trees that have subsea wellheads.

A method is provided for retrofitting and repurposing an existing mobile offshore drilling unit (MODU) for service as a floating production system capable of drilling, evaluating, completing, maintaining, intervening, improving, and/or producing from wells penetrated into a subsurface, subterranean oil and gas reservoir located beneath a body of water that includes: obtaining a right to modify and use the existing MODU, where the existing MODU has a drilling derrick, a moonpool, a marine drilling riser and tensioner system, a subsea blowout preventer (BOP) and cart transport system, marine drilling riser storage and handling equipment, and a dynamic positioning system comprising thrusters, a power generation and management system, and a positioning control system; removing the marine drilling riser and tensioner system, the subsea BOP and cart transport system, the marine drilling riser storage and handling equipment; building and/or installing a structural assembly that is located at least partially in the moonpool, wherein the structural assembly is movable, where the structural assembly has at least two riser holders, and where each riser holder is designed and built to hold a top-tensioned riser that is stretched between the riser holder and components at or near a seabed for production of hydrocarbons from the subterranean reservoir, and building and/or installing means for moving the structural assembly for aligning a top end of first one riser and then a different riser below the drilling derrick.

BRIEF DESCRIPTION OF THE DRAWINGS

A better understanding of the invention can be obtained when the detailed description of exemplary embodiments set forth below is considered in conjunction with the attached drawings in which.

FURTHER INTRODUCTION OF THE INVENTION

Figure 1:
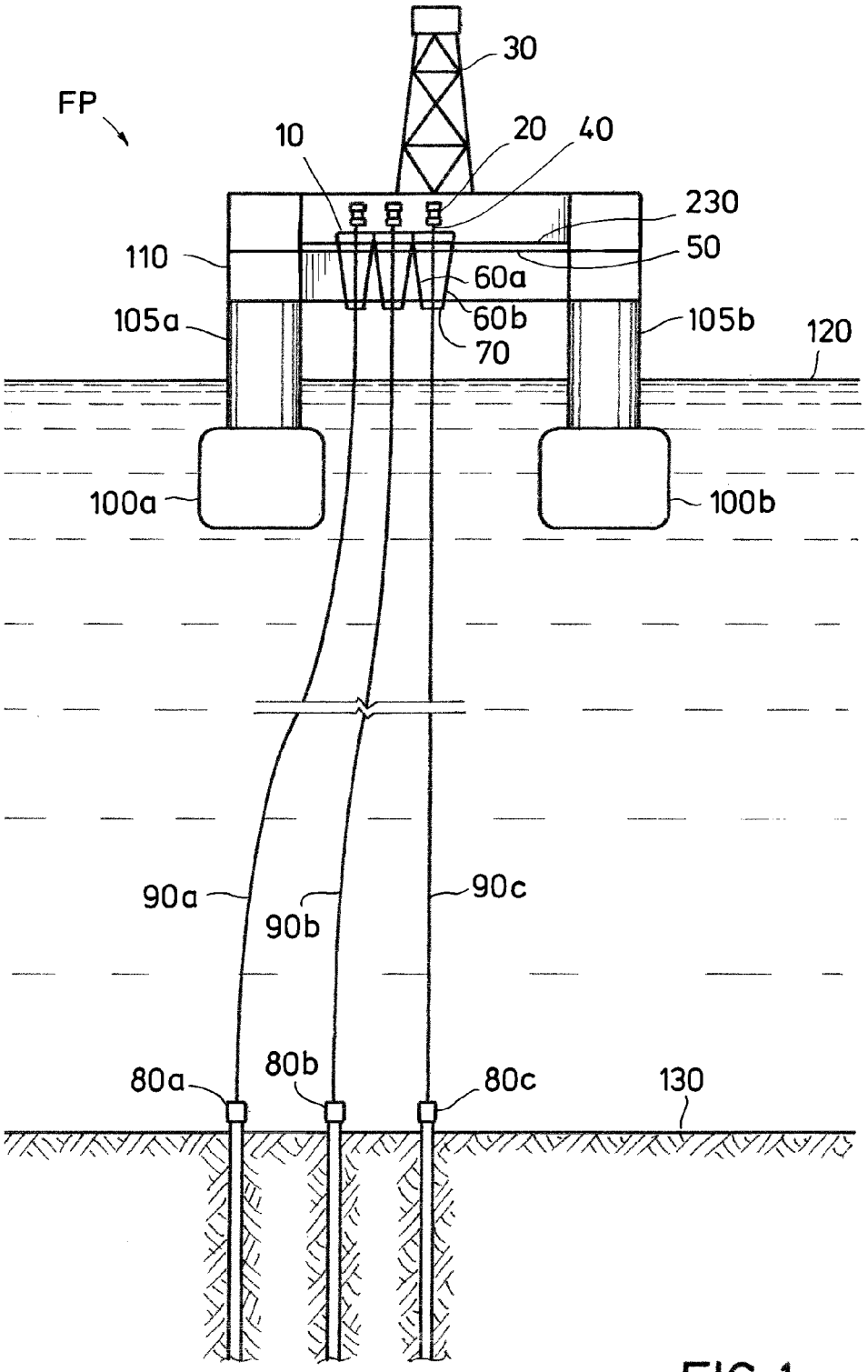
FIG. 1 shows an existing floating semisubmersible drilling rig converted into a floating drilling, completion, and production facility with a movable wellbay structure supporting multiple top tensioned well tieback risers retrofitted into its moonpool.

Industry has advanced the use of dry trees on floating platforms by using mooring systems that hold the facility in a tight watch circle above a cluster of subsea wells and by designing hulls that minimize heave and, hence, riser stroke. All platform design solutions currently in practice employ the same drilling and completion technology using a wellbay structurally fixed into the platform sub-structure with a drilling rig standing on a skidding system on the top deck such that the rotary table and draw works can be moved and secured over any one of the slots for vertical access tieback risers in the fixed wellbay.

Dry tree tieback systems have been installed on many tension-leg platforms (TLPs) and deep-draft spar platforms. Many engineering firms have proposed designs for deep draft semisubmersibles over the past few decades (ref. "State of the art for dry tree semi technologies", by Yu Hao et al, Engineering Science, 2013) but none have been built for deep water field development. In the same way as practiced for spars and TLPs, the deep-draft semisubmersible designs all employ wellbays supporting the top-tensioned dry tree tieback risers and their riser tensioning systems that have a fixed horizontal position within the floating production facility. Some of the designs do allow for the wellbay structure to move vertically while being permanently constrained to a preferred horizontal position within the moonpool.

Although many mobile offshore drilling units (MODUs) have been converted to service as floating production facilities producing from remotely distributed subsea completed wet tree tieback systems, the typical practice is to remove all of the drilling systems and well operations capabilities to make deck space and payload available for the installation of production equipment.

The idea of converting an existing semisubmersible MODU into floating production facility with dry trees is not generally considered feasible by industry today due to the inability to move the drilling derrick on the top deck and because of the large heave of these units during extreme storms. In 1980, a semisubmersible was converted to support production from three subsea completed wells that were tied back to its moonpool with a unique split tree design that placed wet trees at the seabed with 4.5" tubing vertically tied back to dry trees supported on pairs of tensioning guideline wires at the surface (ref. "Dorada Field Production System: A solution to permanent vertical access to several wells from a semi-submersible", Montoya and Lopez-Fanjul, OTC 4041). The Dorada field was located in shallow waters (93 m deep) of the relatively mild Mediterranean Sea offshore Spain. In this case, when well access was required, any one of the 3 surface trees could be tugged individually from a position at the edge of the moonpool to be held beneath the derrick for well operations in a solution similar to concepts for moving surface wellheads into position from stalls at the side of a moonpool described by White et al of U.S. Pat. No. 5,150,987, Springett et al of WO2016054610A1, and Jordan et al U.S. Pat. No. 9,238,943.

It is readily observed that moving a drilling derrick, all of its associated systems, and suspended loads about on the top deck affects the center of gravity and stability of the unit. Such a modification to an existing semisubmersible MODU is complex and costly. It also means that more of the deck area of the unit will be required for drilling operations—meaning that less space is available for oil and gas production equipment. The innovation of the present invention eliminates the need to modify an existing MODUs drilling derrick and support systems in a way intended to allow it to be moved around the deck. Instead, a new movable wellbay structure is retrofitted into the moonpool beneath the fixed derrick with elements that move the entire structural frame to position each slot and its wellhead as needed for direct well access for downhole activities, like drilling or workover.

By recognizing and advantageously using the inherent elasticity of a top-tensioned metallic tie-back riser as a large and long spring, it is possible to maintain the well systems in a safe and reliable state even during the most extreme storms. In locations where metocean conditions are mild, it is possible to use the elasticity of a long tensioned riser string to completely accommodate the offsets and motions of the hull supporting the risers without attaching any dynamic tensioning devices. In locations subject to severe metocean conditions, it is possible to limit the stroke of the riser tensioning system by allowing the dynamic tensioners to "bottom out" while riser stretch accommodates and actually constrains further displacement of the hull.

Allowing the tensioners to bottom out and the risers to stretch can significantly reduce the relative movement of the dry trees within the moonpool and overall heave of the vessel. Restricting the range of allowed relative vertical movement of the wellheads attached to the innovative wellbay structure described in this patent application means that the dry trees and BOPs affixed atop the wellheads will remain above the sea surface in all operating conditions. By adopting an operating philosophy for implementation of this innovation that allows the risers to stretch and go slack, there is no need to build a low heave vessel like a deep draft semisubmersible, TLP, or spar. By incorporating this innovation, existing modern, ultra-deep water semisubmersible MODUs can be economically converted to serve as floating production facilities with dry trees.

BROAD DESCRIPTION OF THE EXEMPLARY EMBODIMENTS

This disclosure relates to an innovative top tension riser support and tensioning system that can be retrofitted in the moonpool of an existing MODU or incorporated into a newly-built MODU. Many of the latest generation MODU's have massive BOP and subsea tree transporter cart systems to move the equipment into and out of the moonpool area for deployment or retrieval as required. The present invention provides a new top tension riser support system comprising a movable wellbay structure that houses the top tension riser tensioners and is able to be preferentially displaced laterally in the moonpool on adjustable tensioners, skid rails, geared tracks or wheels. For the purposes of implementing this riser top tensioning system, the subsea BOP, and subsea BOP handling system are removed from the moonpool, and the moonpool is modified to accept and carry the loads induced by retro-fitting with a movable wellbay structure supporting top-tensioned risers and their tensioners, which forms a movable wellbay system.

The movable wellbay structure is designed to provide the structural interface between the top tension risers, which are fixed to the earth at the seabed to a subsea wellhead and the MODU. The tensioners provide top tension to the top tension risers and also feature an ability to extend and retract in a dynamic stroking function to manage the top tension during the operational and survival metocean design conditions. The movable wellbay structure can move laterally along guides in the moonpool to position any one of the top tension risers under the rig floor and rotary table so that the converted MODU's drilling and completion systems can be connected to the top tension riser at the top of the riser so as to provide direct vertical access to top tension riser with various well drilling, control, evaluation, completion, production, monitoring and intervention elements, including, for example, a surface BOP, a surface production tree and/or a low pressure telescopic joint connected to the rotary table. The movable wellbay structure is moved laterally in the moonpool and is locked into position below the rotary table using multiple and redundant passive locking devices similar to what is in use today on offshore platform rig skidding systems. The movable wellbay structure will remain in the locked position for the duration of the drilling and completion activities on the well, unless the operations are interrupted temporarily by a storm-induced rig abandonment. If such a temporary interruption is required, the well will be secured and the movable wellbay structure may be relocated to and locked into a centralized position most suitable for survival in extreme weather event.

The movable wellbay structure is the key technology required to convert an existing semisubmersible MODU to a production system with top tensioned risers and, if desired, dry tree tieback systems. Alternatively, this movable wellbay structure may be recognized as the key technology required to convert an existing semisubmersible MODU to a production system providing direct vertical access to multiple subsea wells located beneath the facility via top tensioned tieback and workover intervention risers. The scope of the conversion may include, but not be limited to, removing the existing marine drilling riser and tensioner system, the subsea BOP and its transport cart system, the marine drilling riser storage/handling equipment, and the DP thrusters, power management and control and positioning systems from the MODU. In addition to being modified by retrofitting the movable wellbay structure into the facility's moonpool, the MODU is modified to accept connection to a pre-set polyester or steel wire rope taut-leg mooring system, production equipment and control systems, and export systems and risers as service requirements and space and weight constraints dictate.

In this embodiment, a structural frame that can both support top-tensioned tie-back risers for multiple wells and be preferentially re-positioned horizontally so that any one of the wellheads attached to the top of each well tie-back riser can be situated directly beneath the rotary table of the drilling derrick centrally positioned on the deck of a semisubmersible is designed so that it can be retro-fitted into the moonpool of an existing floating semisubmersible drilling unit. This movable wellbay structure sits on a flat beam, rail or track that allows the wellbay structure and the wellheads and risers it supports to be pushed, pulled, skidded or driven to each preferred position and securely locked into position for well operations and/or survival situations.

The movable wellbay structure described above may be designed and fabricated as a single structural frame comprising all the intended well slots or as separate structural frames for each or a pair of well slots that can be mechanically linked to act as a unified wellbay structure.

Once the length of each well tie-back riser is built up to a calculated target length by inserting "spacing out" pup joints (as typically used in offshore well tie-back practice) on top of a length comprised of standard length joints, top tensioning devices are connected and an engineered target top tension is applied to bring and hold the riser at a preferred suspended configuration. At this point, depending upon the operating and environmental conditions to which the total system may be exposed, the water depth in which the semisubmersible facility is installed, and upon the expected extreme horizontal offsets and motion characteristics of the semisubmersible facility once it has been installed, the top ends of the risers and their respective wellheads may be locked to the movable wellbay structure or attached to it by individual tensioning devices.

A key to making this innovation work is to ensure that the semisubmersible facility is held tightly on position over the wellheads located at the seafloor. Most of the high capability semisubmersible drilling units suitable for conversion to the service envisioned for this innovation have modern dynamic-positioning systems provided as part of the design package when leaving the shipyard. A dynamic positioning system can maintain a tight watch circle above the wellheads on the seabed in most sea states when functioning properly but may not have the positioning capability or reliability to keep the semisubmersible on station in all conditions. Therefore, it is anticipated that conversion of an existing semisubmersible to service for this innovation will require it be modified to allow it to be secured on site by a pre-installed taut-leg mooring system as typically used to hold floating production facilities on station in very deep waters. To limit the influence of offset on the tension variation in risers locked to the movable wellbay structure and/or the range of stroke required in the top tensioning devices, it is expected that the station-keeping system adopted will limit the most extreme offset in any condition to less than about 5 percent of water depth.

The possibility for locking down the top ends of top tensioned risers comprised of steel, aluminum, titanium and/or fiber composite tubulars is enhanced when the wells are located in deep waters or in relatively mild ocean environments, or a combination of both. It is also possible to modify the submerged portions of the semisubmersible hull to enhance its hydrodynamic performance to limit motions in a way that allows the riser top ends to be locked to the movable wellbay structure, thus avoiding the need for dynamic tensioning devices.

If the movable wellbay structure is itself supported by motion-compensating stroking devices that can accommodate some or all of the horizontal offset effects and motions of the semisubmersible in the deep water ocean environment, then the opportunity for locking the riser top ends to it is enhanced such that the need for individual dynamically adjusting top tensioning devices can be avoided.

Typically, buoyancy elements are attached and distributed along the body of the risers to limit the amount of top tension required to keep the riser in a suspended string configuration that suitably manages stress in all the tie-back riser components in all operating and survival conditions.

Dynamically adjusting devices providing top tensions to the individual top tensioned risers can be of any form already in application for floating production systems in deep waters. These top-end tensioners maintain a reasonable range of top tension variation for each riser while stroking in or out to accommodate the horizontal displacements and motions of the semisubmersible hull floating in a deep offshore environment. The tensioning devices are typically attached to a load bearing structural element in or attached to an upper section of the top-tensioned riser string that is called a "tensioning ring". The attachment point for this tensioning ring should account for the stroke being provided by the tensioning devices.

The riser tensioning devices, called tensioners, can be direct acting of push-up/down or pull-up/down hydraulic rod and barrel type or wireline type or some combination of both. The attachment of the tensioners to the load bearing tensioning ring can be such that the risers are freely suspended from the movable wellbay structure or are housed within a guiding structure that is a rigid part of its frame and extends along the entire length of the vertical stroking movement to provide lateral restraint. In mild environments, it may also be possible to employ simple or compound springs as dynamic tensioners, as seen in industry and used on at least one TLP in southeast Asian waters.

The means and surface equipment needed for drilling and completing production wells and producing, processing, and exporting oil and gas production wells through these tie-back risers and surface wellheads that place the most critical valve and control systems in a dry surface environment are already well known and proven to those practiced in the art.

As an alternative to or in addition to the movable wellbay structure supporting a well drilling riser and/or production risers that provide direct access through surface mounted wellheads and production trees or a BOP into subsea wells located beneath the converted semisubmersible facility, one or more of the wellbay slots may be dedicated to supporting a tie-back riser that delivers production from and direct wellbore access into a subsea well located beneath the converted semisubmersible facility that is completed and produced through a subsea production tree.

As an alternative to or in addition to the movable wellbay structure supporting top tension well drilling or production risers that provide direct access through surface mounted wellheads and well control components into subsea wells located beneath the converted semisubmersible facility, one or more of the wellbay slots may be dedicated to supporting a tie-back riser that delivers production from one or more local or remote subsea wells completed with subsea trees. This top-tensioned riser can provide direct access to subsea separation and/or lifting equipment located on the seabed beneath the converted semisubmersible facility as well as providing flow paths for separated oil and gas flow streams. This top-tensioned riser can be designed for direct access to and recovery of key components of the separation and/or lifting equipment (such as electric submersible lift pumps or other downhole equipment) at the seabed. Having these capabilities comprised in the total system of the semisubmersible converted (or newly built) for the drilling, completion, production, intervention, maintenance, processing and exporting service described above enables field operators to gain valuable data and insights regarding productive performance characteristics of the reservoirs, the locations and configurations of the well bores, and the completion systems installed in the directly accessible and remote subsea wells.

The first preferred embodiment provides a method that converts an existing mobile offshore drilling unit (MODU) such that it will have the capacity for drilling, completion and maintenance of oil and/or gas wells, and production, processing and export of hydrocarbon fluids when riser top tensioning systems are attached to a movable wellbay structure supporting top tensioned tie-back risers from multiple subsea wells or other subsea production elements and allowing individual riser top ends to be located directly beneath a fixed or movable drilling derrick/rotary table or other operating devices located within or above the moonpool when the movable wellbay structure and appurtenances are retrofitted into its moonpool. The movable wellbay structure of this embodiment includes upper structural elements as part of its overall frame structure, which are intended to transfer by contact the loads imposed by the weight of the movable wellbay structure and by the risers and well control or production equipment supported by the structure to rails or tracks on a mid-level deck (or multiple decks) of the converted MODU. The interface between the load transferring elements and the rails or tracks is designed with low friction surfaces, bearings, wheels or gearing that will allow translation of the movable wellbay structure in the desired direction, and when desired, be mechanically locked into a fixed position. The movable wellbay structure of this embodiment with riser tensioners and all supporting structures providing enough tensioning stroke and load bearing capacity to accommodate the normal operating and survival weather-induced motions when said movable wellbay structure is retro-fitted into the moonpool on the rig to convert it to serve as a floating production facility. The movable wellbay of this embodiment in which any of the wellbay slots designed to support top-tensioned production risers is also designed to allow the installation and use of a drilling riser string and well control devices affixed to the top of the top-tensioned drilling riser string. The movable wellbay of this embodiment that is made as a single structural frame comprising all the intended well slots or as separate structural frames for each or a pair of well slots that can be mechanically linked to act as a unified wellbay structure.

The movable wellbay structure of the first embodiment in which a structural element, commonly called a "tensioning ring" which incorporates features to avoid stress concentrations and may incorporate extensive framing elements, affixed to or part of a riser joint at the top of each of the top-tensioned riser strings supported by said movable wellbay structure is securely guided by a geared track or sliding contact with a rigid beam or rail built in as part of the movable wellbay structure frame structure extending vertically the entire range of stroke of the tensioning devices affixed between said movable wellbay structure and the tensioning ring and/or other guide devices attached to the riser, wherein the friction between the tensioner ring and other devices and the rigid beam or rail of the sliding contact is reduced by treating the contact surface of the tensioner ring's interfacing elements with a low friction coating or by affixing a pad or pads of low friction material to the contact faces of said ring and or the rigid beam or rail.

The facility described in the first embodiment can be used to appraise oil and gas reservoirs and to dynamically test by producing hydrocarbon fluids the suitability of various well completion technologies and schemes for the commercial production of hydrocarbon fluids contained in such subterranean reservoirs.

The movable wellbay structure of the first embodiment can support surface wellheads that allow direct vertical access to wells into reservoirs or to seabed pumps for lift of remotely tied back subsea (wet tree) wells from low pressure reservoirs.

The first embodiment can be designed to balance stretch and slack capacity of very long risers and the amount of distributed buoyancy affixed along the risers with the design stroke of the tensioners to manage stresses in the tieback risers supported on the movable wellbay structure of the first embodiment during normal operating and survival weather events and including shock absorbers and damping devices at the up and down-stroke stops to limit dynamic stress variations when stroke limits are reached.

The movable wellbay structure in the first embodiment can have the surface wellheads fixed to it without providing any dynamic tensioner stroke, and all motions and offsets can be accommodated by riser stretching and slacking.

Instead of having the movable wellbay structure supported on rails, a tensioner stroking interface can be provided between the movable structure of the first embodiment and the floating drilling rig into which it has been retrofitted. In this alternative embodiment, a preferentially adjustable feature to the stroking of the tensioners allows the movable wellbay structure in the first embodiment to be positioned horizontally as needed for direct access into any one of the risers.

The movable wellbay structure of the first embodiment can be fixed into a secure position or guided and constrained by mechanical and/or structural means to survive extreme storm conditions.

Another aspect of the first embodiment is modification of the motions' response of the floating facility supporting the movable wellbay structure of the first embodiment in extreme conditions with tension variation (stretch) in a centrally located set of risers (as well as the stretching and slackening of the lines of a mooring system that is added in place of or in addition to the DP system of the ultra-deep water MODU).

The hydrodynamic characteristics of the hull of the existing semisubmersible of the first embodiment can be modified to reduce its motions in waves and, thus, required stroke of the tensioners or stretch of the risers when such reduction of vertical response will not result in unacceptable increase in wave impact effects on the deck or well systems structures or equipment. There are many proven and practiced techniques for changing semisubmersible motions in waves, such as changing the ratio of surface-piercing column area to the volume of the submerged pontoon hulls by increasing their volume and planform area or by adding structurally reinforced plate extensions from the pontoons (usually inward or outward from the bottom plate or from an internal flat near the baseline) that significantly increase the added mass and damping hydrodynamic characteristics.

Another aspect of the first embodiment of the invention is replacing and/or modifying equipment on an existing semisubmersible MODU to incorporate the movable wellbay structure of the first embodiment to support and provide direct access to wells tied back to the converted facility by top-tensioned risers and to enable well completion, reservoir fluid production, processing, and exporting operations in addition to drilling operations.

A second embodiment of the present invention is a method for incorporating the movable wellbay structure of the first embodiment into the design and construction of a new-build semisubmersible floating facility designed for extended operations at a deep water site with capabilities and systems for drilling, completing, and maintaining wells and producing, processing, and exporting hydrocarbons from a subterranean reservoir. Such a new-build facility may also incorporate the capacity and systems for temporarily storing produced hydrocarbon fluids.

A third embodiment of the present invention is a method for incorporating the movable wellbay structure of the first embodiment into the design and construction of a new-build monohull floating facility designed for extended operations at a deep water site with capabilities and systems for drilling, completing, and maintaining wells and producing, processing, and exporting hydrocarbons from a subterranean reservoir. Such a new-build facility may also incorporate the capacity and systems for temporarily storing produced hydrocarbon fluids.

DETAILED DESCRIPTION OF THE EXEMPLARY EMBODIMENTS

Turning now to the drawings, with reference to FIG. 1, the present invention provides in one embodiment an offshore floating platform FP outfitted with a movable wellbay structure (10) that supports top-end tensioned and buoyancy supported tie-back risers (90*a*-90*c*) with surface wellheads which can be preferentially positioned beneath a drilling derrick (30) standing on a deck box structure (110). As depicted in the figure, one of the three wellheads (40) with its production tree (20) is positioned for direct well access. The movable wellbay structure (10) sits on and can be locked down on a skidway or track on a strengthened mid-level deck structure (50) in the moonpool of a deep water semisubmersible drilling unit that is converted for the well drilling, completion, improvement, maintenance and production service enabled by this invention. The moonpool is a large open space approximately in the center of the semisubmersible deck structure (110) which is affixed to the tops of columns (105*a* and 105*b*) of the semisubmersible hull with adequate buoyancy provided by the displacement of submerged pontoons (100*a* and 100*b*) and partially submerged columns (105*a* and 105*b*) such that the deck box structure (110) and all of the movable wellbay structure (10) and every surface production tree (20) remain well above the sea surface (120) in normal operating conditions. A pair of riser top-end tensioning devices (60*a* and 60*b*) connected to a riser top-end tension support ring (70), which provides adequate tensioning and stroking capability to hold the tie-back riser (90*c*) in a suspended string configuration as necessary to limit stresses within the tie-back riser. Each of the three top-tensioned tie-back risers (90*a*-90*c*), held in their slots in the movable wellbay structure by tensioners (60*a* and 60*b*), is stretched between its own tension support ring (70) and a subsea wellhead (80*a*-80*c*) to which it is connected at or near the seabed (130).

Figure 2:
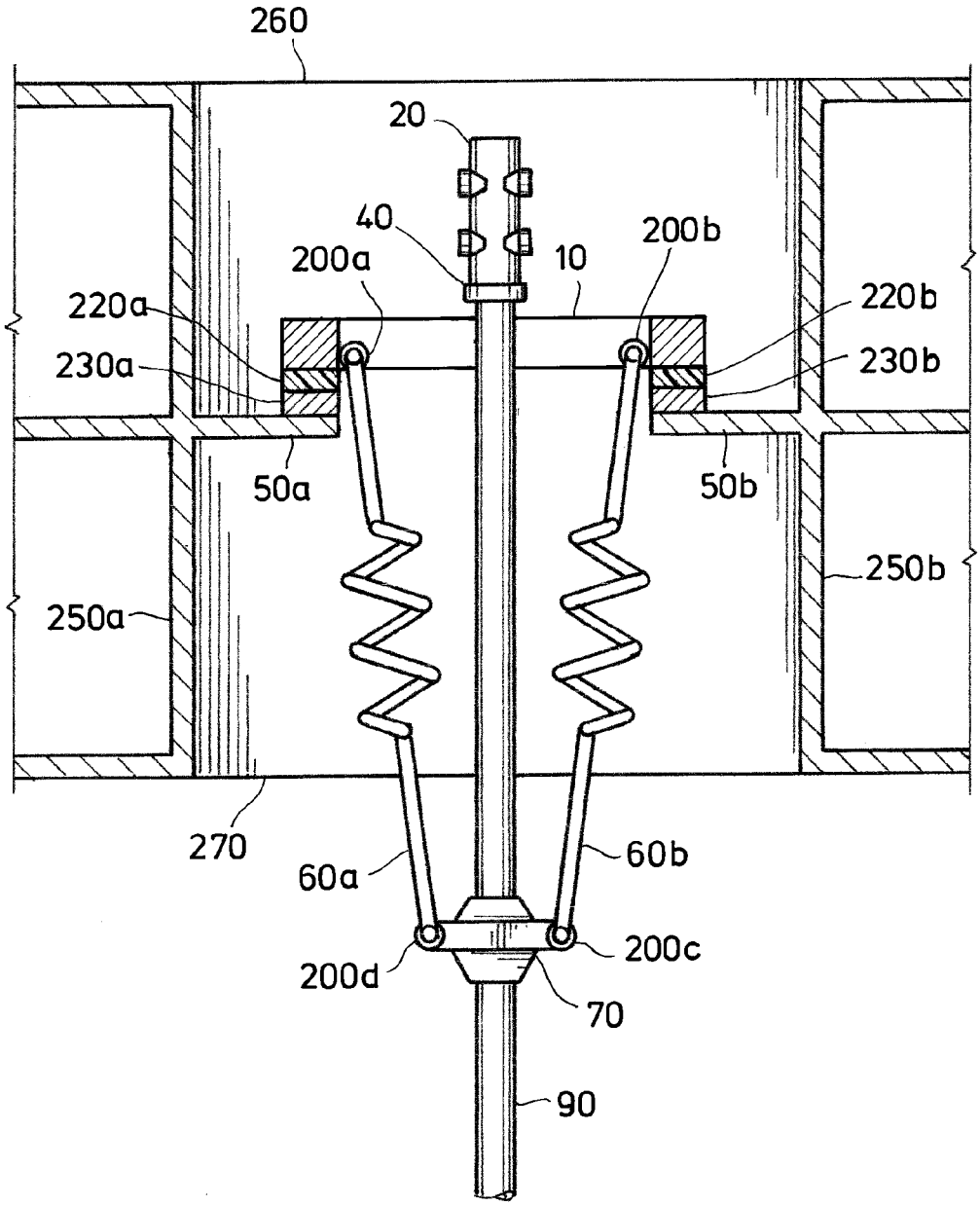
FIG. 2 shows a cross-section of a single well slot in a multiple well slot movable wellbay structure comprising a structural steel frame to support a set of individual riser tensioners for each well.

With hidden lines eliminated for clarity, FIG. 2 is a side elevation in a cross-section of a single well slot in a movable wellbay structure of this embodiment that is comprised of multiple well slots as retro-fitted into the moonpool of a converted MODU delimited by an upper deck (260) and a lower deck (270) and bulkheads (250*a* and 250*b*) at each side of a moonpool. The movable wellbay structure includes a structural frame (10) to support the individual riser tensioners (60*a* and 60*b*) for each well. The movable wellbay structure (10) is designed to either slide on skids or roll on wheels, bearings or gears laterally on moonpool guide rails (230*a* and 230*b*) that are secured to a structurally reinforced mid-level deck (50*a* and 50*b*). A low friction material, such as ultra-high molecular weight plastic, can be inserted and secured as a friction-reducing pad (220*a* and 220*b*) between the skid rail and the frame of the movable wellbay structure (10) to limit the force to move the wellbay structure (10) laterally along rails (230*a* and 230*b*). In this embodiment, a surface production tree (20) is shown sitting on and affixed to a surface wellhead (40) at the top of a top-tensioned riser string (90) that is supported in the dedicated well slot of the movable wellbay structure (10) by tensioning devices (60*a* and 60*b*) affixed to the riser tensioning ring (70) and the movable wellbay structure (10) by pinned end or ball joint connectors (200*c*-200*d* and 200*a*-200*b*, respectively).

Ideally, the tensioning devices (60*a* and 60*b*), such as hydraulically actuated cylinder and rod sets, provide nearly constant tension to the tensioning ring (70) while stroking in and out to accommodate relative motions between the movable wellbay structure (10) and the tensioning ring (70) as the semisubmersible unit to which the movable wellbay structure is affixed moves under the influences of the environment in which it is operating.

The range of stroke of the tensioning devices (60*a* and 60*b*) can be designed to ensure that the up stroke and down stroke limits are never exceeded during any expected conditions. However, to save money on the cost of the tensioning devices, the inherent elasticity of the long top-tensioned riser strings (90*a*-90*c*) can be used to advantage by balancing the stretch of said riser strings to be safely within the elastic range of stress while limiting the design stroke range of the tensioning devices (60*a* and 60*b*). In other words, as long as allowable stress limits within the risers, tensioning devices, and associated components are not exceeded when extreme relative movements of the tensioning ring (70) cause the tensioning devices to bottom out or top out, it is reasonable to limit the stroke range of the tensioning device allowing occasional bottoming out or topping out. When the downward stroke range limit is reached by relative movement of the tensioning ring (70), the top tension on the risers will increase rapidly as the riser stretches. A shock absorbing and damping system can be installed at the top and/or bottom of the tensioner stroke range to minimize the shock and vibration involved with the transition from freely stroking to topping or bottoming out. Operational or accidental changes in draft of the semisubmersible hull (comprised of submerged pontoons 100*a*-100*b* and partially submerged columns 105*a*-105*b*) should be avoided or limited to minimize the design stroke requirements for the tensioning devices (60).

When desired, a specific slot of the movable wellbay structure can be positioned with its wellhead situated under the rotary table such that, after the well has been stabilized, the surface production tree (20) can be removed, and a surface BOP and low pressure telescopic joint can be attached to the wellhead and attached to the diverter housing or mud return system under the rotary table. In this configuration, the converted MODU's rig has full functionality on the well, albeit with a surface BOP and top tensioned riser system rather than a subsea BOP and marine drilling riser system.

Oil and gas production from individual wells is transferred to production equipment installed on the converted semisubmersible unit via flexible pipe jumpers or other transfer means similar to what is used on spars and TLP's. Such fluids transfer is proven practice with jumpers tied back to a production manifold which in turn is connected to onboard process facilities and flare and/or vent systems.

Figure 3:
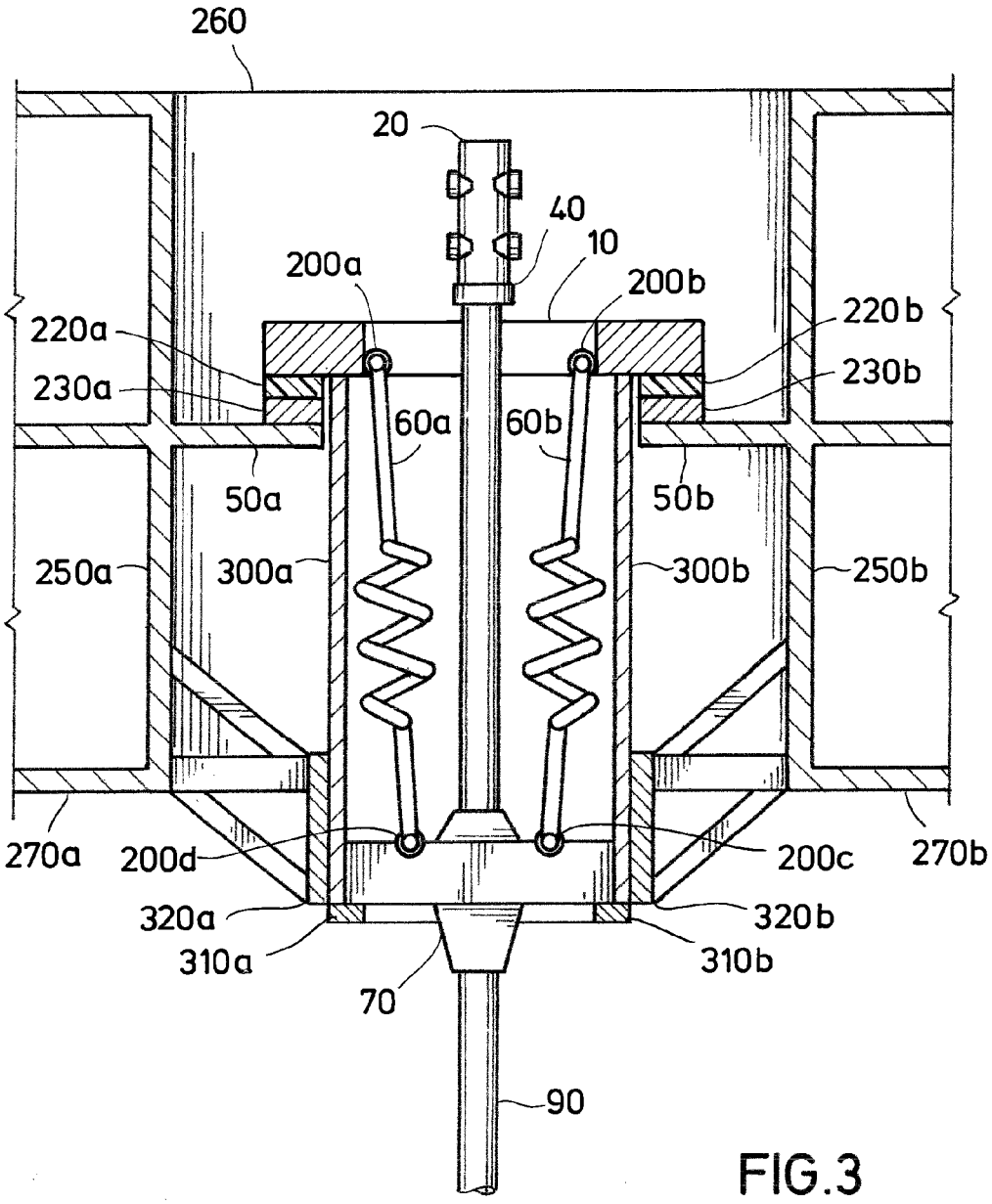
FIG. 3 shows a cross-section of a single well slot in a multiple well slot movable wellbay structure comprising a structural steel frame to support a set of individual riser tensioners for each well wherein the tensioning ring to which the tensioners are attached is guided by rigid rails that are incorporated into the frame of the movable wellbay structure.

With reference to FIG. 3, the movement of the tensioning ring (70) can be constrained to a desired path (essentially parallel to the vertical bulkheads forming the sides of the moonpool) while the tensioning devices (60*a* and 60*b*) allow relative movement between it and the movable wellbay structure (10) by including on each side and as part of the structural frame of the movable wellbay structure vertical guide rails (300*a* and 300*b*) with travel stops (310*a* and 310*b*) that are, in turn, prevented from moving horizontally (side-to-side) by contact with horizontal guide rails (320*a* and 320*b*) located such that the rails (300*a* and 300*b*) can extend below the bottom deck of the moonpool (270*a* and 270*b*) and is affixed to a support frame structure that holds it rigidly in position by connection to the plates and structures reinforcing the side of the moonpool (250*a* and 250*b*) and the bottom of the deck (270*a* and 270*b*).

Figure 4:
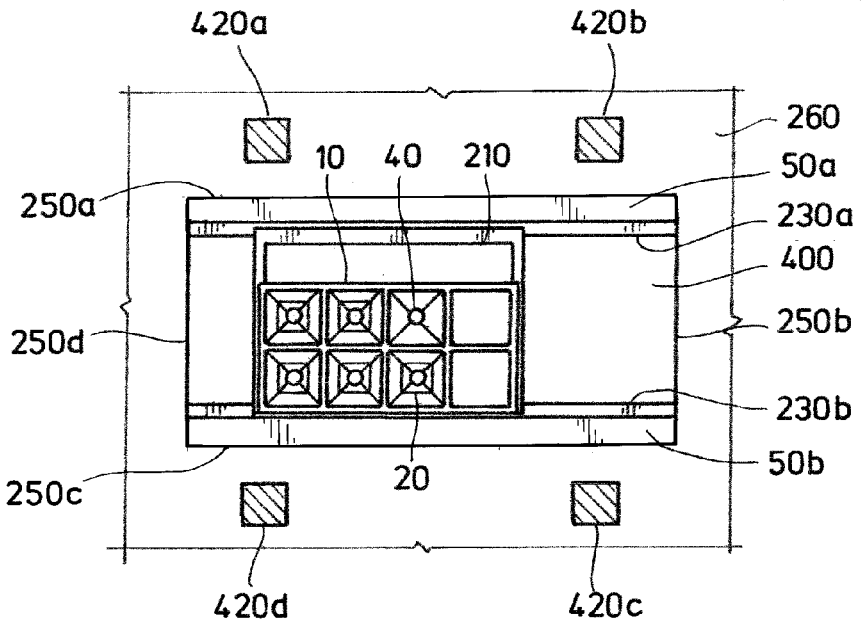
FIG. 4 shows a plan view of an 8-slot movable wellbay structure in the moonpool of a floating production facility with one wellhead at the top of a tensioned riser located directly beneath the drilling center of the deck-mounted derrick tower.

FIG. 4 is a plan view of a moonpool (400) through the deck of a floating production facility and defined by the bulkheads (250*a*-250*d*) which form its sides is shown with a movable wellbay structure introduced to allow for direct vertical access to the seafloor through up to eight top-tensioned drilling and/or production risers. The movable wellbay configuration shown in FIG. 4 allows for both lateral and transverse movement across the area of the moonpool (400) such that any one of the eight top-tensioned riser slots can be placed beneath the fixed derrick's rotary and/or beneath other operating devices located in or above the moonpool when desired (enabling simultaneous well or production operations if desired). The movable wellbay structure can be moved both laterally and transversely to position anyone of the top tension risers directly beneath the drilling center of the deck-mounted derrick tower. Four footings of the derrick tower (420*a*-420*d*) are shown as symmetrically arranged on the deck (260) of the floating drilling, completion, and production unit about the centerline of the moonpool (400). Five of the wellbay slots are occupied by surface production trees supported on a set of four dynamic tensioning devices (20). All of these production trees will typically be connected to a production header and monitored and/or controlled by jumper lines and control umbilicals. A wellhead supported by a tensioner set (40) is positioned beneath the derrick rotary and ready to have its production tree attached. Two of the slots in the wellbay are shown as empty. A massive steel frame that forms the length-wise translating component (210) of the movable wellbay system is shown as supporting another massive steel frame that forms the width-wise translating movable wellbay structure component (10) that directly supports, in this case, up to eight top-tensioned risers. The massive steel frame forming the length-wise translating component (210) of the movable wellbay system is supported by and, when needed, can be locked to the heavy steel rails or tracks (230*a* and 230*b*) along which it translates or moves. Each rail or track (230*a* or 230*b*) is in turn supported by strengthened mid-decks (50*a* and 50*b*) along the sides of the moonpool (400). The design concepts introduced here can be used for building a movable wellbay assembly that has more than eight slots.

Figure 5:
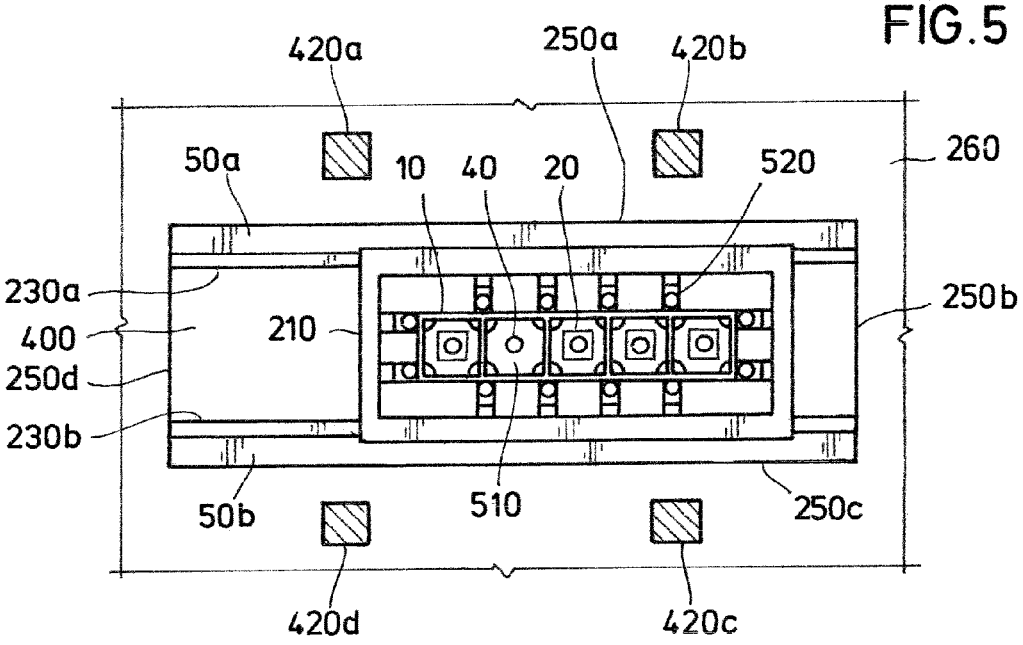
FIG. 5 shows a plan view of a 5-slot movable wellbay structure in the moonpool of a floating production facility with all slots of the wellbay integrated into a single structural frame that is supported by tensioner sets which allow it to slide vertically within the confines of a structural frame in response to offsets and motions of the facility.

FIG. 5 is a plan view of a moonpool (400) through the deck of a floating production facility defined by the bulkheads (250*a*-250*d*) which form its sides is shown with a movable wellbay structure (10) allows or provides direct vertical access to the seafloor through up to five top-tensioned drilling and/or production risers. The movable wellbay configuration shown in FIG. 5 allows for lateral movement along the area of the moonpool (400) such that any one of the five top-tensioned riser slots can be placed beneath the derrick's rotary and/or beneath other operating devices located in or above the moonpool when desired. Four footings of the derrick tower (420*a*-420*d*) are shown as symmetrically arranged on the deck (260) of the floating production facility about the centerline of the moonpool (400). In this configuration, all five of the wellbay slots of the rigid frame of the wellbay structure (10) that is allowed and guided to move vertically as a unit are occupied by top-tensioned risers that are locked to the structural deck (510) of each slot's structural frame. Four of the slots in the movable wellbay structure are shown as having surface production trees (20) affixed atop the top-tensioned production risers. One of the wellheads (40) at the top of a tensioned riser is positioned beneath the derrick rotary ready to have its production tree attached. The massive steel frame forming the length-wise translating component (210) of the movable wellbay is supported by and, when needed, can be locked to the heavy steel rails or tracks (230*a* and 230*b*) along which it translates as well as to other lateral and/or vertical supports at multiple vertical locations as required. The rails or tracks (230*a* and 230*b*) are in turn supported by the strengthened mid-deck (50*a* and 50*b*) along the sides of the moonpool (400). The rigid frame of the movable wellbay structure (10) that is allowed and guided to move vertically as a unit supported along its periphery on as shown in this example, twelve hydraulic rod or wire tensioner units (520) that allow the vertical movement along geared tracks or rigid rails with low friction surface treatments or pads extending vertically and supported laterally over the entire motion-compensating length of travel.

An alternative to having the top ends of the tensioned risers fixed rigidly into the structural tension-bearing deck rigidly fixed into the five slots in the movable wellbay structure in FIG. 5 would be to provide a set of tensioners in each slot as shown in FIG. 4 to allow each of the risers to individually and differentially move, stretch or slide while the whole wellbay also moves vertically as a unit. In this way, the total stroke range targeted for managing stretch and stress in the risers can be split between the twelve tensioners (520) allowing essentially vertical displacement of the movable wellbay structure and individually dedicated sets of tensioners.

Figure 6:
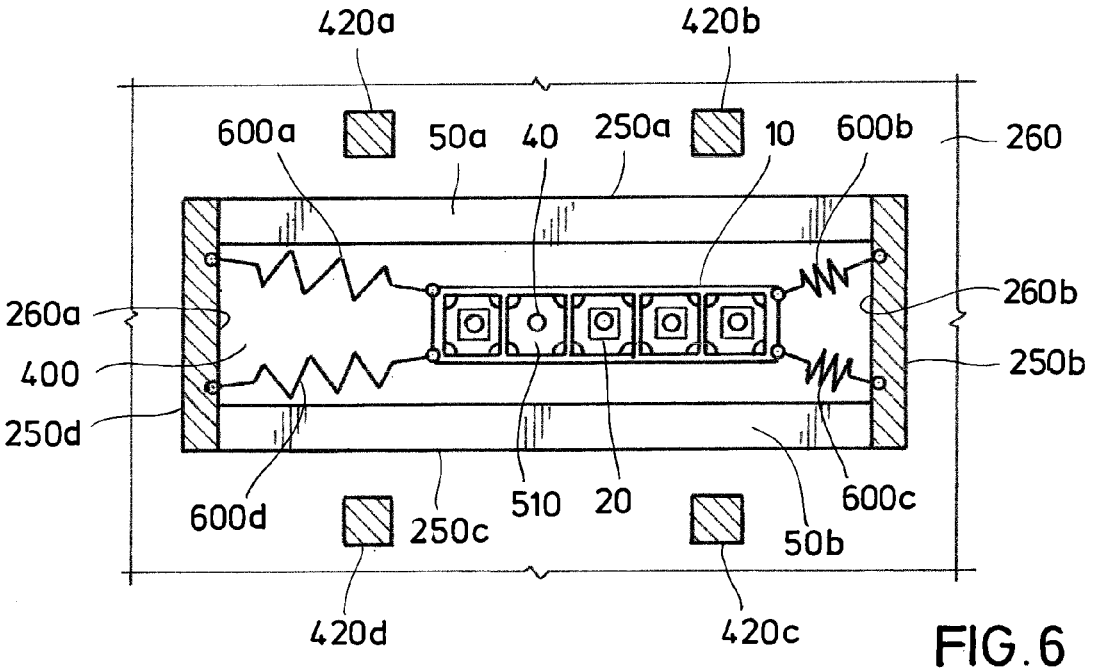
FIG. 6 shows a plan view of a 5-slot movable wellbay structure in the moonpool of a floating production facility with all slots of the wellbay integrated into a single structural frame that is supported by tensioner sets that allow it to be preferentially positioned horizontally and move vertically in response to of sets and motions of the facility.

FIG. 6 is a plan view of a moonpool (400) through the deck of floating production facility and defined by the bulkheads (250*a*-250*d*) which form its sides is shown with a movable wellbay structure introduced to allow for direct vertical access to the seafloor through up to five top-tensioned drilling and/or production risers. The movable wellbay configuration shown in FIG. 6 allows for lateral movement along the area of the moonpool (400) such that any one of the five top-tensioned riser slots can be placed beneath the derrick's rotary and/or beneath other operating devices located in or above the moonpool when desired. Four footings of the derrick tower (420*a*-420*d*) are shown as symmetrically arranged on the deck (260) of the floating production facility about the centerline of the moonpool (400). In this configuration, all of the wellbay slots of the rigid frame of the movable wellbay structure (10) that is allowed to move vertically as a unit are occupied by top-tensioned risers that are locked to the structural deck (510) that is rigidly fixed into each slot's structural frame. Four of the slots in the movable wellbay are shown as having surface production trees (20) affixed atop the top-tensioned production risers. A slot may hold a production tree and a BOP on the well beneath the rotary table. One of the wellheads (40) at the top of a tensioned riser is positioned beneath the derrick rotary ready to have its production tree attached. The rigid frame of the movable wellbay structure (10) is allowed to move vertically as a unit supported at its ends on four hydraulic tensioner units (600*a*-600*d*) connected at their top ends to rigid structural elements (260*a* and 260*b*) fixed to the bulkheads (250*b* and 250*d*) at the ends of the moonpool (400). While allowing vertical movement, hydraulic tensioner units (600*a*-600*d*) can also be preferentially adjusted by differentially stroking in or out to adjust the horizontal position of the movable wellbay structure such that any one of the wellbay riser slots can be positioned beneath the derrick rotary table or other operating devices mounted in or above the moonpool.

An alternative to having the top ends of the tensioned risers fixed rigidly into the structural deck of the wellbay slot in the movable wellbay in FIG. 6 would be to provide a set of tensioners in each slot as shown in FIG. 4 to allow each of the risers to individually and differentially move, stretch or slide while the whole wellbay also moves vertically as a unit. In this way, the total stroke range targeted for managing stretch and stress in the risers can be split between the tensioners (600*a*-600*d*) supporting the movable wellbay structure and individually dedicated sets of tensioners.

Figure 7:
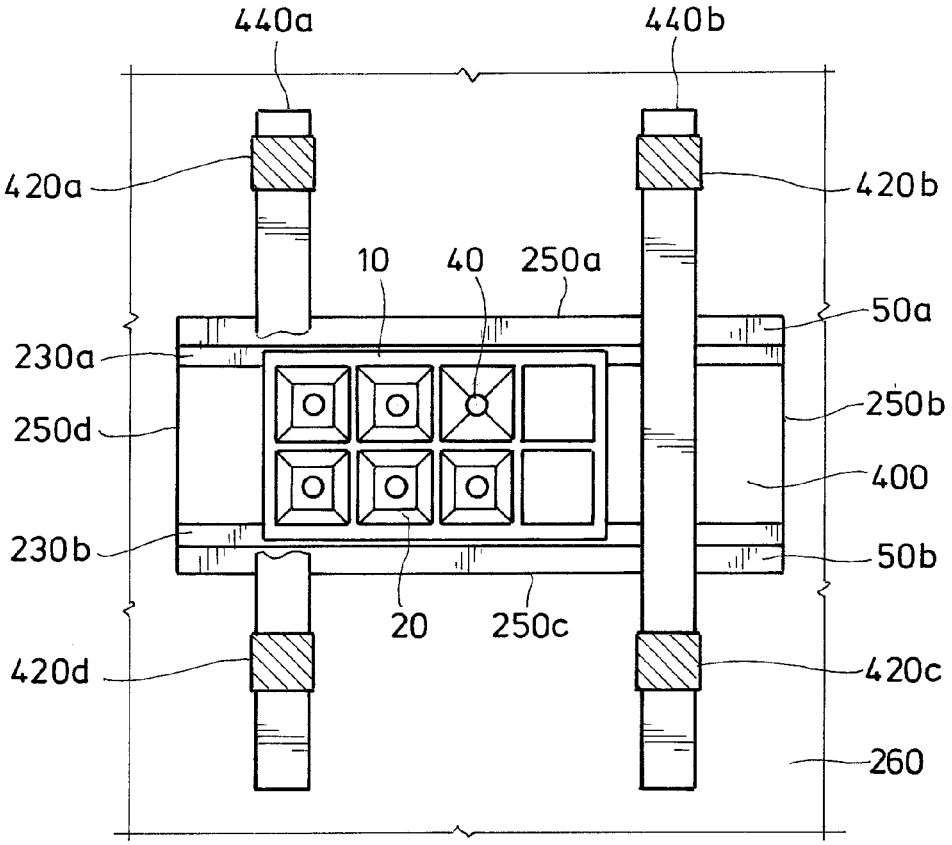
FIG. 7 shows a plan view of an 8-slot movable wellbay structure in the moonpool of a floating production facility with one wellhead at the top of a tensioned riser located directly beneath the drilling center of a deck-mounted derrick tower wherein the tower has been skidded to a position for access to that wellhead.

FIG. 7 is a plan view of a moonpool (400) through the deck of a floating production facility defined by the bulkheads (250*a*-250*d*) which form its sides is shown with a movable wellbay introduced to allow for direct vertical access to the seafloor through up to eight top-tensioned drilling and/or production risers. The movable wellbay configuration shown in FIG. 7 allows for lateral movement of the wellbay structure along the area of the moonpool (400) while the drilling derrick and associated devices can be displaced orthogonally to either side of the centerline of the moonpool such that any one of the eight top-tensioned riser slots can be accessed directly for well and production operations. Four footings of the derrick tower (420*a*-420*d*) are shown as secured to skid beams (440*a* and 440*b*) on the deck (260) of the floating drilling, completion, and production unit asymmetrically arranged about the centerline of the moonpool (400). Five of the wellbay slots are occupied by surface production trees (20) supported on a set of four dynamic tensioning devices. All of these production trees will typically be connected to a production header and monitored and/or controlled by jumper lines and cables. One of the wellheads supported by a tensioner set (40) is positioned beneath the derrick rotary and ready to have its production tree attached. Two of the slots in the wellbay are shown as empty. The massive steel frame of the movable wellbay structure (10) is supported by and, when needed, can be locked to the heavy steel rails or tracks (230*a* and 230*b*) along which it translates. The rails or tracks are in turn supported by the strengthened mid-deck (50*a* and 50*b*) along the sides of the moonpool (400). The skid beams (440*a* and 440*b*) are shown as traversing the moonpool; however, it is not required that the skid beams cross entirely over the moonpool and could instead extend partially over the moonpool or not over the moonpool at all.

By retrofitting this movable wellbay structure innovation in any of the embodiments described above as the core feature in the conversion of existing semisubmersible drilling units into facilities capable of drilling, completing, intervening, improving, and maintaining wells and producing hydrocarbon fluids from subterranean reservoirs through top tension production risers, it is possible to greatly reduce the cost and lead time for achieving first production as compared to building a new facility of similar capabilities from scratch. Further, the existing semisubmersible converted by including this innovation will also provide a much more timely and cost effective means for producing and gathering critical insights into reservoir characteristics and well completion system performance than either a new or converted floating facility designed to produce from remote subsea wells due to the high cost of drilling, completing, and maintaining such wells when producing from high pressure, high temperature reservoirs located in deep waters.

This innovation has advantages over all prior art by disclosing a means to have multiple top-tensioned drilling and/or production risers connected between the converted MODU and wellheads located at the sea floor while providing the ability to move the surface wellhead atop of any one of these risers to a position directly beneath the rotary table and/or beneath other operating devices located in or above the moonpool of the converted MODU. In order to deploy and support an array of risers, it is preferred to convert the MODU for connection into a fixed taut leg mooring system where the rig maintains an essentially constant mean position and heading over the life of the facility. This is not possible with dynamically-positioned MODUs as they are designed to "weathervane" to minimize the forces imposed by wind, waves and currents. Dynamically-positioned MODU's also must have the ability to perform an emergency disconnect, should well control or station keeping limits be exceeded. Successfully managing an emergency disconnect with multiple risers and subsea BOPs and subsequently and simultaneously retrieving the risers after disconnect is not considered operationally feasible and poses dangerous and unnecessary risk to the facility and crew.

Others (White et al of U.S. Pat. No. 5,150,987, Springett et al of WO2016054610A1, and Jordan et al U.S. Pat. No. 9,238,943) have described a way to move an individual well riser from one location in a moonpool to a position beneath the rotary table of a fixed drilling derrick. Further, Finn et al in U.S. Pat. No. 6,431,284 B1 and U.S. Pat. No. 6,648,074 B2 and Vanvik in U.S. Pat. No. 6,691,784 describe mechanisms that allow moving wellbays vertically. However, no one has contemplated the concept or addressed the challenges of moving an entire wellbay structure to position the individual wellheads as needed beneath the fixed derrick and/or beneath other operating devices located in or above the moonpool. This variation and the inclusion of dynamic riser tensioning devices presents significant design challenges but also enables the effective conversion of an existing MODU into a valuable well drilling, completion, maintenance, improvement, and production facility offering direct vertical access with surface wellheads and BOPs to groups of subsea wells in deep waters.

This innovation does not require a low heave vessel like a deep draft semisubmersible, tension leg platform or spar in any of its embodiments. Industry has advanced the use of dry trees on floating platforms by designing the hull to minimize heave and, hence, riser stroke. All platform design solutions currently in practice employ the same drilling and completion technology using a fixed and stationary wellbay built structurally into the platform sub-structure with a drilling rig built on the top deck on a skidding system where it can be moved and positioned over any one of the fixed wellbay slots. The use of an existing semisubmersible MODU as a dry tree unit has not been considered feasible by industry due to the inability to move the drilling derrick on the top deck, as well as the large heave associated with these units during extreme storms. The innovation of the present invention eliminates the need for the rig to skid on existing purpose-built MODUs, where instead the entire wellbay frame is moved to position the desired wellhead as needed for direct well access for downhole activities, like drilling or work-over by the rig. Further, by advantageously using the inherent elasticity of a top-tensioned metallic tie-back riser as a large and long spring, it is possible to maintain the well systems in a safe and reliable state even during the most extreme storms. In locations subject to severe metocean conditions, it is possible to limit the stroke of the riser tensioning system by allowing the tensioners to "bottom out" where the tensioner stroke reaches a dynamic limit and is arrested by the use of structural restraints and shock absorbing systems to prevent further relative displacement while riser stretch accommodates part of the overall stroke requirement. Allowing the tensioners to bottom out and the risers to stretch can significantly reduce the overall heave of the vessel, enabling the movable wellbay structure and the top tension risers and well control or production equipment it supports to fit practically within the moonpool.

EMBODIMENTS OF THE INVENTION

1. An offshore floating oil & gas well drilling, evaluation, completion, improvement, maintenance and production facility that includes: (1) a semisubmersible vessel or a monohull vessel having a vertical opening referred to as a moonpool, where the vessel has bulkhead and deck structures, including an upper deck called the drilling deck, surrounding the moonpool; (2) a drilling derrick with a primary operating device that may be positioned and/or secured to the drilling deck in a central position over the moonpool, where the drilling derrick may be fixed or movable; (3) mooring lines attached to the vessel for anchoring the vessel; (4) a wellbay assembly located at least partially in the moonpool, where the wellbay assembly is movable, where the wellbay assembly has at least two sets of riser tensioners in an array of structurally distinct positions or slots, where each riser tensioner set is designed and built to hold a riser in tension; and means for moving the wellbay assembly for aligning the top ends of first one of the at least two risers and then a different riser below the drilling derrick.

2. The offshore facility of embodiment 1, where the multiple top tensioned risers enable operations on and production from and vertical access to subsea completed wells with wet trees or surface completed wells with dry trees that have subsea wellheads located on a tight array on the seafloor essentially beneath the floating production facility, possibly where the wellheads are within about 50 feet of each other.

3. The offshore facility of embodiment 1 or 2, where each riser holder further includes a dynamic top tensioning system for holding a riser in tension.

4. The offshore facility of embodiment 1, 2 or 3, where the structural assembly is supported by a dynamic tensioning system which uniformly holds all of the more than two top-tensioned risers uniformly in tension when the risers are rigidly connected to the structural assembly.

5. The offshore facility of any one of embodiments 1-4, where the riser holders for each of the top tensioned risers are arranged such that while one of the riser top ends is located beneath the primary operating device one or more of the top ends of the other risers supported by the structural assembly are positioned beneath one or more other operating devices located in or above the moonpool near the primary operating device such that multiple operations can be performed on, in, or through the risers and their slots in the structural assembly simultaneously. Other operating devices include a secondary derrick and riser running or equipment lowering devices, which can set or pull plugs, run testing protocols on wells, be used to install and remove BOPs and trees. Other operating devices include, but are not limited to: elevators and transport devices for installation of BOP or trees on wellheads; testing kits; robotic devices interfacing with and making connections (e.g., jumper hose or control umbilical stabbing) between trees and production manifolds and hard piping; and a slick-line lubricator tower.

6. The offshore facility of any one of embodiments 1-5, where some or all of the multiple top tensioned risers convey production from remote subsea completed wells with wet trees to production facilities on the floating production system.

7. The offshore facility of any one of embodiments 1-6, where some or all of the multiple top tensioned risers can provide direct vertical access to hydraulic lifting or pumping equipment located beneath the floating production facility at the seabed or within producing wells.

8. The offshore facility of any one of embodiments 1-7, where the floating production facility is a permanently moored vessel that has a monohull or a semisubmersible hull form designed to support all relevant loads in all required metocean conditions.

9. The offshore facility of any one of embodiments 1-8, where the operating devices may each be either fixed in position on the vessel or be capable of being relocated and secured in ways that are advantageous for performing their operating functions individually or simultaneously.

10. A method for retrofitting and repurposing an existing mobile offshore drilling unit (MODU) for service as a floating production facility capable of drilling, evaluating, completing, maintaining, improving, and/or producing from wells penetrated into subsurface (subterranean) oil & gas reservoirs located beneath a body of water, including: (1) obtaining a right to modify and use the existing MODU, where the existing MODU has a moonpool, a marine drilling riser and tensioner system, a subsea blowout preventer (BOP) and cart transport system, marine drilling riser storage and handling equipment, and a non-permanent type spread mooring system suitable for speedy relocation of the MODU and/or a dynamic positioning system comprising thrusters, a power generation and management system, and a positioning control system; (2) removing the marine drilling riser and tensioner system the subsea BOP and cart transport system, the marine drilling riser storage and handling equipment, and, if deemed advantageous, various components of the dynamic positioning systems from the MODU; (3) building and/or installing a structural assembly that is located at least partially in the moonpool, wherein the structural assembly is movable, wherein each riser holder is designed and built to hold a top-tensioned riser that is stretched between the riser holder and components at or near the seabed which allow for production of hydrocarbons from subterranean reservoirs; and (4) building and/or installing means for moving the structural assembly for aligning the top ends of first one of the at least two risers and then a different riser below the drilling derrick. However, an existing moored platform, which does not have a dynamic positioning system and related equipment, can also be converted to a floating oil and gas facility with a movable wellbay assembly.

11. The method of embodiment 10, where either the up stroke or down stroke or the range of both the up and the down stroke of the dynamic tensioners supporting the top tensioned risers is limited by placing mechanical stops and shock absorbing systems at desired positions such that the range of movement of the tension rings attached to the top tensioned risers is constrained while any further dynamic displacement of the hull is accommodated by stretching or compressing the risers.

12. The method of embodiment 10, where either the up stroke or down stroke or the range of both the up and the down stroke of the dynamic tensioners supporting the top tensioned risers is limited by splitting allocation of the targeted stroke range between the tensioners on the wellbay and those on the individual risers.

13. A floating oil and gas production platform installed in deep water that includes: a permanent spread mooring supporting a large centrally located drilling derrick with a primary operating device and a moonpool opening through the deck; a movable structural assembly located at least partially in the moonpool; at least two riser holders designed and built to hold a top-tensioned riser that is stretched between its riser holder and components at or near the seabed that allow for production of hydrocarbons from subterranean reservoirs; and structure and equipment for moving the structural assembly for aligning the top ends of first one of the at least two risers and then a different riser below the drilling derrick and primary operating device or below other operating devices mounted within or above the moonpool, where the operating devices perform functions related to drilling, evaluating, completing, maintaining, improving, and/or producing from wells penetrated into subsurface (subterranean) oil & gas reservoirs located beneath a body of water.

14. The offshore facility or method of any one of embodiments 1-13, where the means for moving the structural assembly is selected from among adjustable tensioners, skids, tracks, geared tracks, pads of low friction material, wheels, rolling, sliding, rails, guide rails, monorail, rack and pinion gears, electric motors, internal combustion engines, pistons, hydraulic pistons, hydraulic systems, crane systems, and push and pull systems.

15. An offshore drilling, completion and production facility that includes: a semisubmersible vessel or a monohull vessel having an opening therethrough referred to as a moonpool, where the vessel has upper and lower decks surrounding the moonpool; a drilling derrick fixed to the upper deck over the moonpool or fixed to a movable structure that is fixed to the upper deck over the moonpool; mooring lines attached to the vessel for anchoring the vessel; a movable structural assembly located at least partially in the moonpool that includes at least two riser holders that are designed and built to hold a riser, and structure and equipment (preferably including a rail system mounted directly or indirectly to the lower deck) for moving the structural assembly for aligning first one riser and then a different riser below the drilling derrick, preferably where each riser holder includes a riser tensioning system for holding a riser in tension 16. The offshore facility of embodiment 15, further including at least two subsea oil and/or gas wells; a riser extending between each well and one of the riser holders; and an assembly of valves, spools, and fittings referred to as a dry tree or a blowout preventer attached directly or indirectly to and in fluid communication with each riser, where the dry tree or the blowout preventer is located above the surface of the water during normal operation.

17. A method for appraising a formation below a seabed that is under water that includes: obtaining a right to modify and use an existing mobile offshore drilling unit (MODU), where the MODU is preferably a floating semisubmersible vessel or a floating monohull vessel, where the existing MODU has a deck, an opening through the deck known as a moonpool, a fixed or movable drilling derrick located above the moonpool that is mounted directly or indirectly to the deck; building and/or installing a movable structural assembly within the MODU that is located at least partially in the moonpool, where the structural assembly has at least two riser holders, and where each riser holder is designed and built to hold a riser; building and/or installing means for moving the structural assembly for aligning first one riser and then a different riser below the drilling derrick; drilling and completing at least two subsea oil and/or gas wells using the drilling derrick and pressure-competent drilling risers; placing a riser between each well and one of the riser holders; attaching an assembly of valves, spools, and fittings referred to as a dry tree or a blowout preventer directly or indirectly to each riser, where the dry tree or the blowout preventer is located above the surface of the water during normal operation; and producing oil and/or gas from the oil and/or gas wells, where the method preferably includes connecting a dry tree tie-back assembly of valves and controls to the wellhead at the top of the riser.

18. The method of embodiment 17, further including either: (1) attaching an assembly of valves, spools, and fittings referred to as a dry tree or a blowout preventer directly or indirectly to each riser, where the dry tree or the blowout preventer is located above the surface of the water during normal operation, where each riser is designed for full well operating pressure or (2) attaching an assembly of valves, spools, and fittings referred to as a riser base, a wet tree and a subsea choke directly or indirectly to each well below the surface of the water, preferably at the seabed, where the riser base, the wet tree and/or the subsea choke is designed to reduce the pressure of produced oil and/or gas so that each riser can be designed for less than full well operating pressure 19. The method of embodiment 17, further including installing one or more mudline oil and gas separation systems; placing a riser between each mudline separation system and one of the riser holders; completing the oil and/or gas wells; connecting a surface tie-back assembly of valves and controls to the wellhead at the top of the riser; and producing oil and/or gas from the oil and/or gas wells through the mudline separation system.

20. The method of any one of embodiments 17-19, further including adding production facilities and export systems for producing oil and/or gas from the oil and/or gas wells drilled into said reservoir and producing from said reservoir to gather data and generate insights about the productivity of the reservoir and the means for implementing effective well completions.

21. The method of any one of embodiments 17-20, where the structural assembly is made movable using one or a combination of adjustable tensioners, skids, tracks, geared tracks, wheels, rolling, sliding, rails, guide rails, monorail, rack and pinion gears, pads of low friction material, electric motors, internal combustion engines, pistons, hydraulic pistons, hydraulic systems, crane systems, and push and pull systems.

22. An offshore floating platform for oil and gas well drilling evaluation, completion, improvement, maintenance and/or production, which includes: a semisubmersible vessel or a monohull vessel having a vertical opening referred to as a moonpool, where the vessel has bulkhead and deck structures, and where the vessel has an upper drilling deck that surrounds the moonpool; a drilling derrick with a primary operating device that may be positioned and/or secured to the drilling deck over the moonpool; mooring lines attached to the vessel for anchoring the vessel; a wellbay assembly located at least partially in the moonpool, where the wellbay assembly is movable, where the wellbay assembly has at least two sets of riser tensioners in an array of structurally distinct slots, and where each riser tensioner set is designed and built to hold a riser in tension; and means for moving the wellbay assembly for aligning an upper end of first one riser and then a different riser below the drilling derrick.

23. The offshore floating platform of embodiment 22, where the wellbay assembly comprises a structural frame to support a set of individual riser tensioners for each well and a tensioning ring to which the tensioners are attached, where the wellbay assembly comprises guide rails, and wherein the tensioning ring is guided by the guide rails while stroking up and down.

24. The offshore floating platform of embodiment 23, where the wellbay assembly comprises a grid that has at least two or from 2 to 8 slots and a frame, where the grid is supported by the frame, and where the grid is movable with respect to the frame along one axis.

25. The offshore floating platform of embodiment 24, wherein the frame has opposing parallel edge members, wherein the vessel has a pair of supports, wherein the opposing edge members rest on the pair of supports and are movable back and forth on the pair of supports, and where the movement of the grid on the frame is orthogonal to the movement of the frame on the pair of supports.

26. The offshore floating platform of embodiment 22, where the wellbay assembly comprises a grid that has from 2 to 8 slots, where the vessel has a pair of supports, where the grid rests on the pair of supports and is movable back and forth on the pair of supports along a first axis, where the vessel has a pair of beams or rails that traverse the moonpool, where the derrick is received on the pair of beams or rails and is movable on the pair of beams and rails along a second axis, and where the second axis is orthogonal to the first axis.

27. A system that includes the offshore floating platform of embodiment 22; one or more subterranean oil and/or gas wells; and a riser between each riser tensioner set and a well, preferably further including production facilities on the offshore floating platform, preferably where at least one well is completed with a wet tree for production through the riser to the production facilities, and preferably where at least one well is completed with a dry tree for production through the riser to the production facilities. The system preferably further includes hydraulic lifting or pumping equipment located at the seabed or within a well, where a top end of the riser can be moved by moving the wellbay assembly for providing vertical access to the hydraulic lifting or pumping equipment through the riser. The system preferably also further includes a mudline oil and gas separation system; a riser between the mudline separation system and one of the riser holders; a dry tree on the riser; and a surface tie-back assembly of valves and controls connected to the dry tree for production through the mudline separation system. The means for moving the wellbay assembly in the system is selected from among adjustable tensioners, skids, tracks, pads of low friction material, geared tracks, wheels, rolling, sliding, rails, guide rails, monorail, rack and pinion gears, electric motors, internal combustion engines, pistons, hydraulic pistons, hydraulic systems, crane systems and push and pull systems.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. An offshore floating facility for oil and gas well drilling, evaluation, completion, improvement, maintenance, intervention and/or production, comprising:

a semisubmersible vessel or a monohull vessel having a vertical opening referred to as a moonpool, wherein the vessel has bulkhead and deck structures, and wherein the vessel has an upper drilling deck that surrounds the moonpool;

a drilling derrick with a primary operating device, the drilling derrick secured to the upper drilling deck over the moonpool at a single location;

mooring lines attached to the vessel for anchoring the vessel; and a wellbay assembly located at least partially in the moonpool, wherein the entire wellbay assembly is configured to be laterally and transversely movable at least for aligning at the single location a top end of a first riser of a set of two or more risers and then aligning at the single location a second riser of the set of two or more risers below the primary operating device of the drilling derrick, wherein the wellbay assembly has at least two sets of riser tensioners in an array of structurally distinct slots, and wherein each of the at least two sets of riser tensioners is designed and built to hold one of the set of two or more risers in tension.

2. The offshore floating facility of claim 1, further comprising structure and equipment for enabling operations on and production from and vertical access to subsea completed wells with wet trees or surface completed wells with dry trees that have subsea wellheads.

3. The offshore floating facility of claim 1, further comprising a dynamic top tensioning system for each of the at least two sets of riser tensioners for holding each of the set of two or more risers in tension, the dynamic top tensioning system selected from the group consisting of one or more spring tensioners, one or more wire rope tensioners, and one or more hydraulic tensioners, and combinations thereof.

4. The offshore floating facility of claim 1, further comprising a dynamic tensioning system for the wellbay assembly for holding each of the set of two or more risers uniformly in tension, the dynamic tensioning system selected from the group consisting of one or more spring tensioners, one or more wire rope tensioners, and one or more hydraulic tensioners, and combinations thereof.

5. The offshore floating facility of claim 1, further comprising a secondary operating device that is operable over the moonpool, wherein the secondary operating device is either movable with respect to the upper drilling deck for placement over one slot of the array of structurally distinct slots or fixed directly or indirectly to the upper drilling deck, wherein the array of structurally distinct slots allows positioning of the first riser below the primary operating device and positioning of the second riser below the secondary operating device at the same time that the first riser is positioned below the primary operating device so that operations can be performed on, in, or through the first and second risers simultaneously.

6. The offshore floating facility of claim 1, wherein the wellbay assembly comprises components allowing it to move laterally and transversely selected from among adjustable tensioners, skids, tracks, pads of low friction material, geared tracks, wheels, rollers, sliders, rails, guide rails, monorail, rack and pinion gears, electric motors, internal combustion engines, pistons, hydraulic pistons, hydraulic systems, crane systems, and push and pull systems, and combinations thereof.

7. The offshore floating facility of claim 1, wherein each of the at least two sets of riser tensioners is a dynamic tensioner that has an up stroke and a down stroke and a stroke range for each of the up stroke and the down stroke, and wherein either the up stroke or the down stroke or the stroke range of both the up stroke and the down stroke is limited by mechanical stops and a shock absorbing system.

8. The offshore floating facility of claim 7, wherein the wellbay assembly comprises a structural steel frame to support each set of the at least two sets of riser tensioners for each well and a tensioning ring to which the riser tensioners are attached, wherein the wellbay assembly comprises guide rails, and wherein the tensioning ring is guided by the guide rails while stroking up and down.

9. The offshore floating facility of claim 1, wherein the wellbay assembly has 2, 3, 4, 5, 6 or 8 slots.

10. The offshore floating facility of claim 1, wherein the wellbay assembly comprises a grid that defines the array of structurally distinct slots, the array having at least two of the distinct slots, and a frame, wherein the grid is supported by the frame, and wherein the grid is movable with respect to the frame along one axis.

11. The offshore floating facility of claim 10, wherein the frame has opposing parallel edge members, wherein the vessel has a pair of supports, wherein the opposing parallel edge members rest on the pair of supports and are movable back and forth on the pair of supports.

12. The offshore floating facility of claim 11, wherein the grid, the frame, and the pair of supports are configured such that movement of the grid on the frame is orthogonal to movement of the frame on the pair of supports.

13. A method for retrofitting and repurposing an existing mobile offshore drilling unit (MODU) for service as a floating production facility capable of drilling, evaluating, completing, maintaining, improving, and/or producing from wells penetrated into a subsurface (subterranean) oil and gas reservoir located beneath a body of water, the existing MODU comprising a drilling derrick, a moonpool, the drilling derrick secured to the drilling deck over the moonpool at a single location, and any one or more of the following 1) a marine drilling riser and tensioner system, 2) a subsea blowout preventer (BOP) and cart transport system, 3) marine drilling riser storage and handling equipment, 4) a dynamic positioning system comprising thrusters, 5) a power generation and management system, and 6) a positioning control system, the method comprising the steps of;

(a) if one or more of the marine drilling riser and tensioner system, the subsea BOP and cart transport system, and the marine drilling riser storage and handling equipment are present, then removing the marine drilling riser and tensioner system, the subsea BOP and cart transport system, and the marine drilling riser storage and handling equipment, and if the marine drilling riser and tensioner system, the subsea BOP and cart transport system, and the marine drilling riser storage and handling equipment are not present, then proceeding with step (b); and (b) building and/or installing a structural assembly that is located at least partially in the moonpool, wherein the entire structural assembly is configured to be laterally and transversely movable at least for aligning at the single location a top end of first one riser of a set of two or more risers and then aligning at the single location a different riser of the set of risers below the drilling derrick, wherein the structural assembly has at least two riser holders, and wherein each riser holder is designed and built to hold a top-tensioned riser that is stretched between the riser holder and components at or near a seabed for production of hydrocarbons from the subterranean oil and gas reservoir.

14. A system, comprising:

(a) an offshore floating facility for oil and gas well drilling, evaluation, completion, improvement, maintenance, intervention and/or production, the offshore floating facility comprising:

a semisubmersible vessel or a monohull vessel having a vertical opening referred to as a moonpool, wherein the semisubmersible vessel or the monohull vessel has a bulkhead and one or more deck structures, and wherein the semisubmersible vessel or the monohull vessel has an upper drilling deck that surrounds the moonpool;

a drilling derrick with a primary operating device, the drilling derrick secured to the upper drilling deck over the moonpool at a single location over the moonpool;

mooring lines attached to the semisubmersible vessel or the monohull vessel for anchoring the semisubmersible vessel or the monohull vessel, wherein the vessel is anchored; and a wellbay assembly located at least partially in the moonpool, wherein the entire wellbay assembly is configured to be laterally and transversely movable at least for aligning at the single location a top end of a first riser of a set of two or more risers and then aligning at the single location a top end of a second riser of the set of two or more risers below the drilling derrick, wherein the wellbay assembly has at least two sets of riser tensioners in an array of structurally distinct slots, and wherein each set of the at least two sets of riser tensioners is designed and built to hold one of the set of two or more risers in tension;

(b) one or more subterranean oil and/or gas wells; and (c) one of the set of two or more risers extending between one of each set of the at least two sets of riser tensioners and one of the one or more subterranean oil and/or gas wells.

15. The system of claim 14, further comprising production facilities on the offshore floating facility, wherein at least one of the one or more subterranean oil and/or gas wells is completed with a wet tree for production through one riser of the set of two or more risers to the production facilities.

16. The system of claim 14, further comprising production facilities on the offshore floating facility, wherein at least one of the one or more subterranean oil and/or gas wells is completed with a dry tree for production through one riser of the set of two or more risers to the production facilities.

17. The system of claim 14, further comprising hydraulic lifting or pumping equipment located at a seabed or within one of the one or more subterranean oil and/or gas wells, wherein the top ends of each riser of the set of two or more risers can be moved by moving the wellbay assembly laterally and transversely for providing vertical access to the hydraulic lifting or pumping equipment through each riser of the set of two or more risers.

18. The system of claim 14, further comprising a mudline oil and gas separation system; one of the set of two or more risers between the mudline oil and gas separation system and one set of the at least two sets of riser tensioners; a dry tree on the one of the set of the at least two sets of riser tensioners; and a surface tie-back assembly of valves and controls connected to the dry tree for production through the mudline oil and gas separation system.

19. An offshore floating facility for oil and gas well drilling, evaluation, completion, improvement, maintenance, intervention and/or production, comprising:

a semisubmersible vessel or a monohull vessel having a vertical opening referred to as a moonpool, wherein the vessel has bulkhead and deck structures, and wherein the vessel has an upper drilling deck that surrounds the moonpool, the moonpool having an area and a centerline;

a drilling derrick with a primary operating device;

mooring lines attached to the vessel for anchoring the vessel; and a wellbay assembly located at least partially in the moonpool, wherein the wellbay assembly comprises a grid defining an array of two or more structurally distinct slots, each slot having one set of a corresponding two or more sets of riser tensioners therein, and wherein each of the corresponding two or more sets of riser tensioners is designed and built to hold one of a set of two or more risers in tension;

wherein the vessel has a pair of supports, wherein the grid rests on the pair of supports and is configured to be only laterally movable on the pair of supports along a first axis laterally along the area of the moonpool, wherein the vessel has a pair of beams or rails, wherein the drilling derrick and primary operating device are received on the pair of beams or rails and are only movable orthogonally along a second axis to either side of the centerline of the moonpool on the pair of beams and rails;

whereby any one of the set of two or more risers can be accessed directly for the oil and gas well drilling, evaluation, completion, improvement, maintenance, intervention and/or production.

* * * * *